US006386683B1

(12) United States Patent
Muroi et al.

(10) Patent No.: US 6,386,683 B1
(45) Date of Patent: May 14, 2002

(54) PRINTING APPARATUS AND PRINTING METHOD THEREFOR

(75) Inventors: Kunimasa Muroi; Koji Toda, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/611,911

(22) Filed: Jul. 7, 2000

(30) Foreign Application Priority Data

Jul. 12, 1999 (JP) ..... 11-197627

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 101, 102; 399/271, 290, 292, 293, 294, 295

(56) References Cited

U.S. PATENT DOCUMENTS 4,895,629 A 1/1990 Castegnier et al.
6,045,674 A 4/2000 Castegnier

FOREIGN PATENT DOCUMENTS

| | | |
|---|---|---|
| EP | 0253358 | 1/1988 |
| EP | 0822462 | 2/1998 |
| GB | 2245866 | 1/1992 |
| JP | 58-96573 | 6/1983 |
| WO | 90/11897 | 10/1990 |

*Primary Examiner*—Raquel Yvette Gordon
(74) *Attorney, Agent, or Firm*—Dickstein Shapiro Morin & Oshinsky LLP

(57) ABSTRACT

In a printing apparatus for forming a desired image by coagulating a portion of liquid ink in a predetermined space S formed between a circumferential surface of a rotation drum and a plurality of negative electrodes by electrical energizing, and transferring this to a printing object such as paper, to thereby affect printing, there is provided on a rotation input side of the plurality of negative electrodes a discharge port whereby a fluid can be discharged towards the negative electrode surface and the surroundings thereof. Moreover, there is provided a fluid supply device for supplying a fluid (which may be a liquid or a gas) to the discharge port.

19 Claims, 4 Drawing Sheets

PRINTING APPARATUS AND PRINTING METHOD THEREFOR

BACKGROUND OF THE INVENTION

1. Field of the Invention

The present invention relates to a printing apparatus, and more particularly to a printing apparatus for forming a desired image by coagulating a portion of liquid ink by electrical energizing, and transferring this to a printing object such as paper, to thereby affect printing, and to a printing method therefor.

2. Description of the Related Art

This type of printing apparatus is applicable to many kinds of low volume printing, and is disclosed for example in Published Japanese translation No. Hei 4-504688 of PCT (WO 09011897). This apparatus comprises: a rotation drum with a circumferential surface functioning as a positive electrode; a plurality of negative electrodes arranged at a predetermined spacing in an axial direction of the rotation drum and facing the circumferential surface of the rotation drum by a predetermined distance; an injector for injecting and replenishing liquid ink from a rotation input side to (upstream of) the space between the negative electrodes and the circumferential surface of the rotation drum; a coating unit arranged on the rotation input side (upstream) of the injector for coating an olefinic substance containing a metallic oxide onto the circumferential surface of the rotation drum; an energizer for energizing selected negative electrodes of the plurality of negative electrodes in a condition with ink disposed between the negative electrodes and the positive electrode, to thereby coagulate and adhere part of the ink onto the circumferential surface of the rotation drum to form a desired image; a removal device arranged on a rotation output side (downstream) of the space, for removing residual non-coagulated ink from the circumferential surface of the rotation drum; a transfer device arranged on the rotation output side (downstream) of the removal device for transferring a desired image which has been coagulated and adhered to the circumferential surface of the rotation drum, onto an object to be printed; and a washing device arranged on the rotation output side (downstream) of the transfer device, for washing the circumferential surface of the rotation drum.

With this type of printing apparatus, a portion of the liquid ink filled into the space between the electrodes is coagulated by energizing between the electrodes, and adhered to the circumferential surface of the rotation drum. The ink which has been coagulated by energizing is also adhered to the surroundings of the negative electrode, so that the negative electrode surface is covered. Due to this, energizing is impaired (printing is impaired). This energizing impairment is solved, as disclosed in the beforementioned publication, by washing the negative electrode surface and the surroundings thereof with a rotating brush or the like. At this time, the printing must be interrupted, thus inviting a drop in printing efficiency.

SUMMARY OF THE INVENTION

The present invention is aimed at dealing with the abovementioned problems, with the object of suppressing the adherence of coagulated ink to the negative terminal surface and the surroundings thereof. The invention is characterized in that in the abovementioned printing apparatus, on the rotation input side of the plurality of negative electrodes there is provided a discharge port whereby a fluid can be discharged towards the negative electrode surface and the surroundings thereof, and there is provided a fluid supply device for supplying a fluid (which may be a liquid or a gas) to the discharge port.

In the printing apparatus according to the present invention, a fluid is supplied from the fluid supply device to the discharge port, and the fluid flows from the discharge port to the negative electrode surface and the surroundings thereof Therefore, the adhering of ink which has been coagulated by energizing, to the negative electrode surface and the surroundings thereof can be suppressed, or the coagulated ink adhered to the negative electrode surface and the surroundings thereof can be washed off. Hence the operation frequency for removing coagulated ink from the surface of the negative electrode and the surroundings thereof, with a removal device such as a rotating brush can be reduced (or eliminated). Therefore the number of printing interruptions can be reduced (or eliminated) and printing efficiency thus increased.

Furthermore, at the time of executing the present invention, in the case where the fluid supplied to the discharge port is an electrolyte containing practically no coagulating component, and the fluid supply device is configured for continually supplying the fluid, then a solution layer of electrolyte can be continuously formed on the negative electrode side in the space between the electrodes. Moreover a solution layer of ink can be continuously formed on the positive electrode side. Consequently, as well as preventing the adherence of ink to the negative electrode surface and the surroundings thereof by means of the solution layer of electrolyte, energizing between electrodes can be performed through the solution layer of electrolyte and the solution layer of ink. Hence extended continuous printing or repetitive printing becomes possible, enabling an improvement in printing efficiency.

Moreover, at the time of executing the present invention, in the case where the fluid supplied to the discharge port is a washing fluid (for example tap water, or a washing liquid containing a solvent, a surface active agent, or the like), and the fluid supply device is configured for momentarily supply the washing fluid at high pressure, then even if the ink which has been coagulated by energizing between the electrodes, is adhered to the negative electrode surface and the surroundings thereof, this same ink can be removed by momentarily supplying the washing fluid at high pressure at a timing such as a pause in the printing during printing. Hence extended continuous printing or repetitive printing becomes possible, enabling an improvement in printing efficiency.

Furthermore, at the time of executing the present invention, in the case where the fluid supply device incorporates a function for cooling the fluid supplied to the discharge port, the negative electrode surface and the surroundings thereof can also be cooled by the fluid supplied from the discharge port. Hence the coagulation of ink by energizing can be suppressed at the negative electrode surface and the surroundings thereof.

DESCRIPTION OF THE PREFERRED EMBODIMENTS

Figure 1:
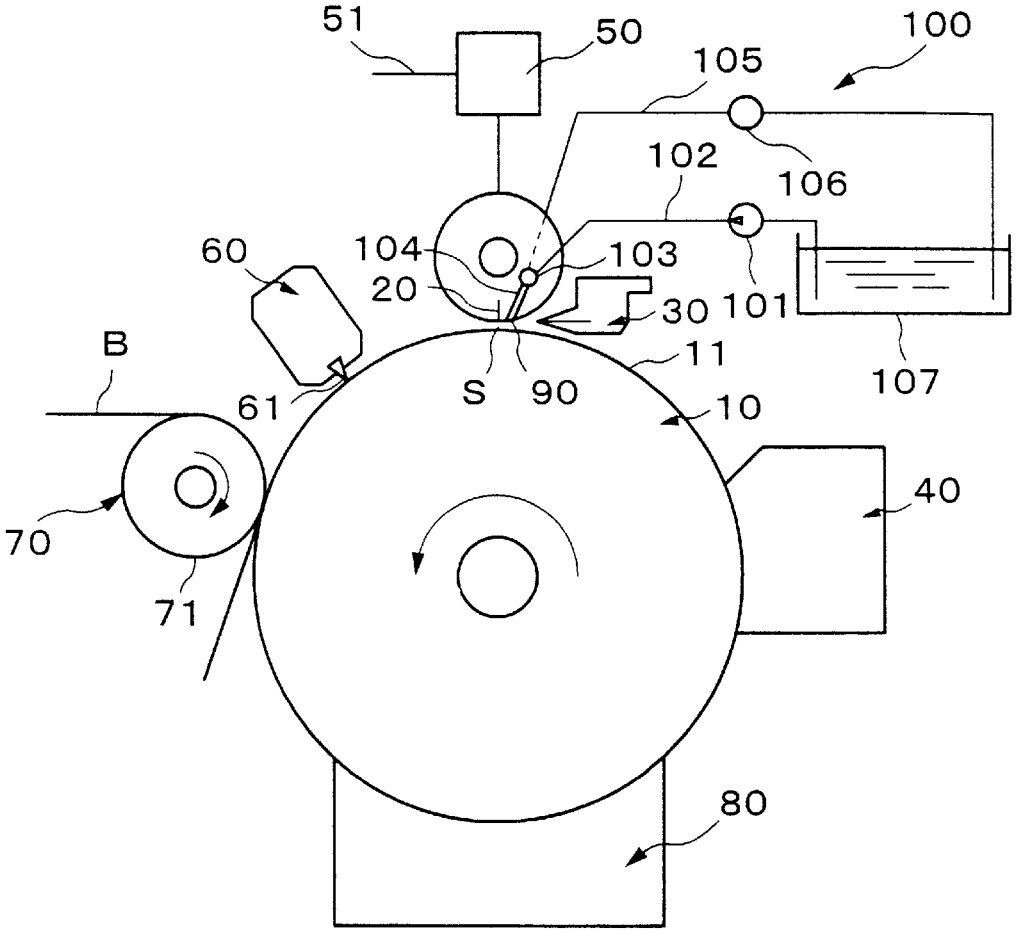
FIG. 1 is an overall structural diagram schematically illustrating an embodiment of an electrocoagulation printing apparatus according to the present invention.

Hereunder is a description based on the drawings of a first embodiment of the present invention. FIG. 1 schematically shows an electrocoagulation printing apparatus according to the present invention. This printing apparatus has a known construction such as disclosed in Published Japanese translation No. Hei 4-504688, comprising a rotation drum 10, negative electrodes 20, an injector 30, a coating unit 40, an energizer 50, a removal device 60, a transfer device 70, and a washing device 80. Moreover this comprises a novel construction in the form of discharge ports 90 and a fluid supply device 100.

Figure 2:
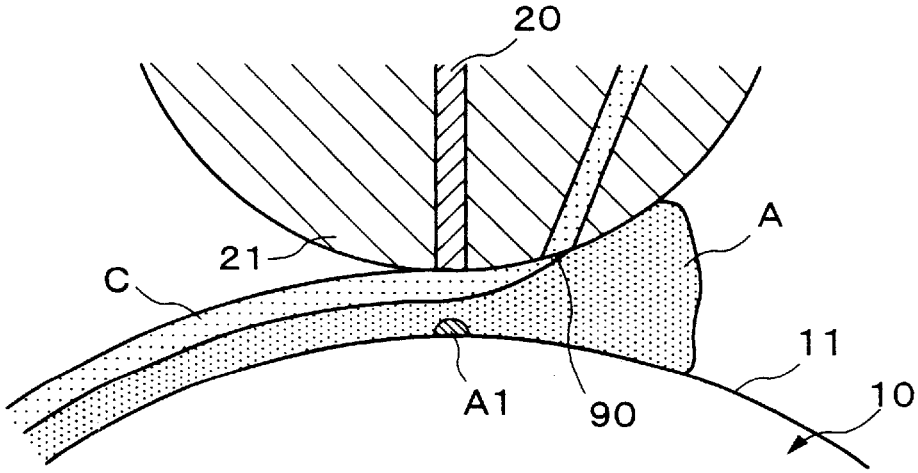
FIG. 2 is an enlarged view of an essential part of FIG. 1.
Figure 3:
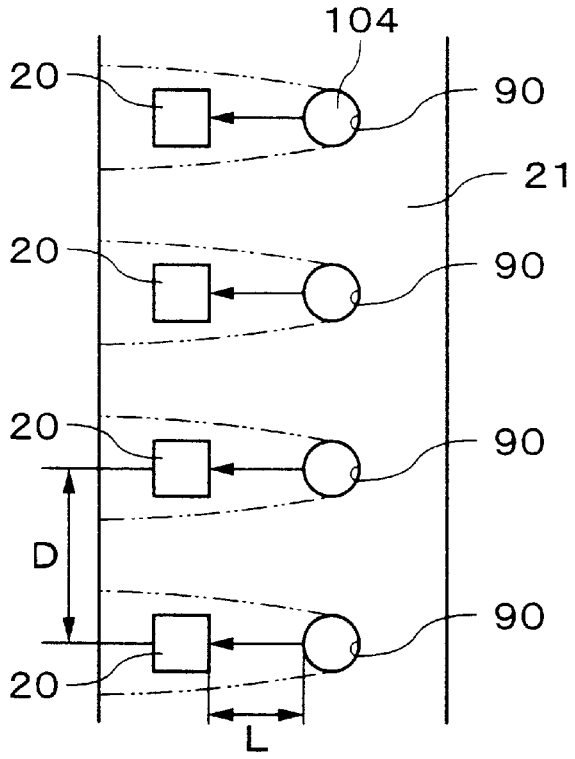
FIG. 3 is a bottom view showing a relation between negative electrodes and discharge ports shown in FIG. 2.

With the rotation drum 10, the cylindrical surface functions as a positive electrode 11, and is rotatably supported in a frame (omitted from the figure) so as to be rotatably driven in a counterclockwise direction as shown in the figure by a drive unit (omitted from the figure). The negative electrodes 20, as shown partially enlarged in FIG. 2 and FIG. 3, are metal electrodes of square section (with one side approximately 30 $\mu$m) embedded in an insulating resin 21, and are multiply arranged in a line at a predetermined spacing D (approximately 60 $\mu$m) in the axial direction of the rotation drum 10. Moreover, these are attached to the frame so as to face the circumferential surface of the rotation drum 10 by a predetermined distance S (approximately 30~100 $\mu$m).

The injector 30 injects and replenishes liquid ink A from the rotation input side to the space between the plurality of negative electrodes 20 and the circumferential surface of the rotation drum 10, and is attached to the frame. The coating unit 40 is arranged on the rotation input side of the injector 30, and attached to the frame, for continuously coating an olefinic substance containing a metallic oxide onto the circumferential surface of the rotation drum 10.

The energizer 50 is for energizing selected negative electrodes of the plurality of negative electrodes 20 in a condition with ink A disposed between the negative electrodes 20 and the positive electrode 11 of the rotation drum 10, to thereby coagulate and adhere a part A1 (refer to FIG. 2) of the ink onto the circumferential surface of the rotation drum 10 to form a desired image. Energizing signals are sent to the energizer 50 from a control unit (not shown in the figure) via a cable 51.

The removal device 60 is arranged on the rotation output side of the space 6 between the electrodes, and has a flexible rubber spatula 61 for removing residual non-coagulated ink from the circumferential surface of the rotation drum 10. The removed ink is then recycled. The transfer device 70 is arranged on the rotation output side of the removal device 60 for transferring a desired image which has been coagulated and adhered to the circumferential surface of the rotation drum 10, onto an object to be printed B such as paper, and incorporates a press roller 71 which rotates in the clockwise direction in the figure. The washing device 80 is arranged on the rotation output side of the transfer device 70 for continuously washing the circumferential surface of the rotation drum 10.

The discharge ports 90 as shown in FIG. 3, are formed in a circular shape (approximately 30 $\mu$m diameter) and are respectively provided in an insulating resin 21 so as to correspond to the respective negative electrodes 20, and on the rotation input side (ink inflow side) thereof. The discharge ports 90 are located at a position separated by a predetermined distance L (which can be appropriately set) from the respective negative electrodes 20, so that an electrolyte C can flow towards the surface of the respective electrodes 20 and the surroundings thereof. As examples of the electrolyte, there are aqueous solutions of salts such as potassium chloride.

The fluid supply device 100 continuously supplies at a predetermined pressure (low pressure), the electrolyte C to the respective discharge ports 90 when liquid ink A is injected from the injection device 30 towards the space S between the electrodes. The fluid supply device 100 comprises; a supply pipe 102 with a supply pump 101 disposed therein, a communicating path 103 provided in the insulating resin 21 with one end connected to the supply pipe 102, a plurality of branch paths 104 provided in the insulating resin-21 each with one end connected to the communicating path 103 and the other end connected to the respective discharge ports 90, a return pipe 105 connected to the other end of the communicating path 103 for returning the surplus electrolyte C to a tank 107, and a control valve 106 disposed in the return pipe 105 for controlling the flow quantity of electrolyte C supplied to the respective discharge ports 90 through the respective branch paths 104. By returning the electrolyte C to the tank 107, the electrolyte C is naturally cooled.

In the electrocoagulation printing apparatus of the present embodiment constructed as described above, desired printing onto the object to be printed B is performed by realizing: a coating process for coating an olefinic substance containing a metallic oxide onto the circumferential surface of the rotation drum 10 with the coating unit 40; an ink replenishing process for injecting and replenishing liquid ink A into the space S between electrodes, by the injector 30; a coagulation process and a process for supplying electrolyte C, for forming a desired image by energizing at a facing portion of the circumferential surface of the rotation drum 10 and the negative electrodes 20 and the rotation input side thereof; a removal process for removing residual non-coagulated ink from the circumferential surface of the rotation drum 10 by means of the removal device 60; a transfer process for transferring a desired image from the circumferential surface of the rotation drum 10 onto the object to be printed B by means of the transfer device 70; and a washing process for washing the circumferential surface of the rotation drum 10 by means of the washing device 80.

Incidentally, in the electrocoagulation printing apparatus of this embodiment, as mentioned above, there is realized a coagulation process and a process for supplying electrolyte C, for forming a desired image by energizing at a facing portion of the circumferential surface of the rotation drum 10 and the negative electrodes 20 and the rotation input side thereof. Furthermore, a solution layer of electrolyte C can be continuously formed on the negative electrodes 20 side in the space S between the electrodes as shown in FIG. 2. Moreover a solution layer of ink A can be continuously formed on the positive electrode 11 side.

Consequently, as well as preventing the adherence of the ink A to the surface of the negative electrodes 20 and the surroundings thereof by means of the solution layer of electrolyte C, energizing between electrodes can be performed through the solution layer of the electrolyte C and the solution layer of the ink A. Moreover, the operation frequency for removing coagulated ink from the surface of the negative electrodes 20 and the surroundings thereof with a removal device such as a rotating brush can be reduced or eliminated. Hence extended continuous printing or repetitive printing becomes possible, enabling an improvement in printing efficiency.

Furthermore, according to the electrocoagulation printing apparatus of the present embodiment, the fluid supply device 100 incorporates a function for cooling the electrolyte C which is collectively supplied to the discharge ports 90. Therefore the surface of the negative electrodes 20 and the surroundings thereof can be cooled by the electrolyte C supplied from the discharge ports 90. Hence coagulation of the ink A at the surface of the negative electrodes 20 and the surroundings thereof due to energizing can be suppressed.

The abovementioned embodiment is effected by adopting the fluid supply device 100 which continuously supplies at a low pressure, the electrolyte C to the respective discharge ports 90 when the liquid ink A is injected from the injection device 30 towards the space S between the electrodes. However with a construction where the timing for supplying the fluid to the respective discharge ports can be suitably set, and for example the fluid supply device rather than being limited to the abovementioned embodiment, can momentarily supply a washing fluid (for example tap water, or a washing liquid containing a solvent, a surface active agent, or the like, or a suitable gas) at high pressure, then the invention can be effected by supplying the washing fluid at high pressure at a timing such as a pause in the printing during printing.

Figure 4:
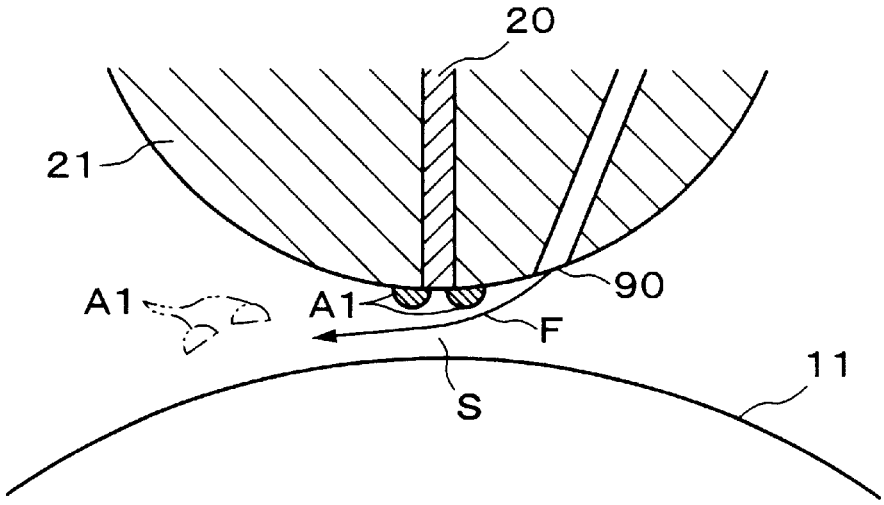
FIG. 4 is an enlarged view of a main part, for explaining a modified embodiment of the present invention.

In a related modified embodiment, as shown in FIG. 4, even if the ink A1 which has been coagulated by energizing between the electrodes, is adhered to the surroundings of the negative electrodes 20, this same ink A1 can be removed (washed off) by momentarily supplying a washing fluid F at high pressure from the discharge ports 90 in the direction of the arrow at a timing such as a pause in the printing during printing. Hence extended continuous printing or repetitive printing becomes possible, enabling an improvement in printing efficiency.

Furthermore, in the abovementioned embodiment and in the modified embodiment, as shown in FIG. 1 through FIG. 3 and in FIG. 4, this is effected by providing the discharge ports 90, and the communicating path 103 and the branch paths 104 of the fluid supply device 100 in the insulating resin 21 which retains the negative electrodes 20. However this may also be effected by providing parts corresponding to the discharge ports 90 and the communicating path 103 and the branch paths 104 of the fluid supply device 100 in a different member to the insulating resin 21 which retains the negative electrodes 20.

Figure 5:
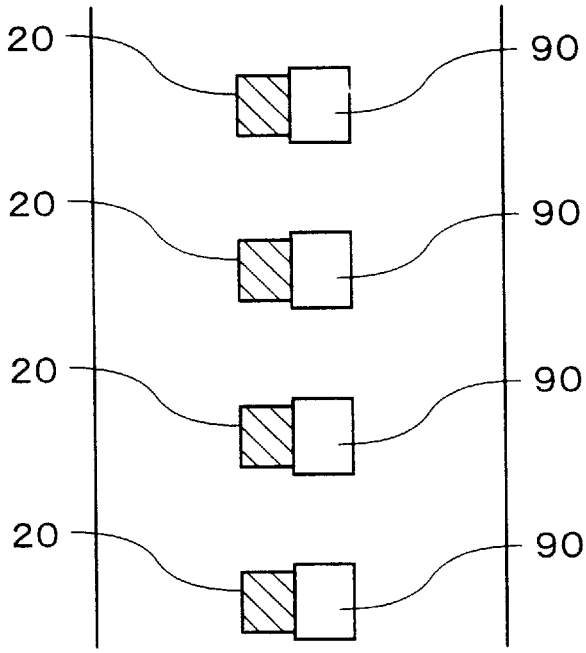
FIG. 5 is a view corresponding to FIG. 3, showing a first modified example of outlet ports provided corresponding to the negative electrodes.
Figure 6:
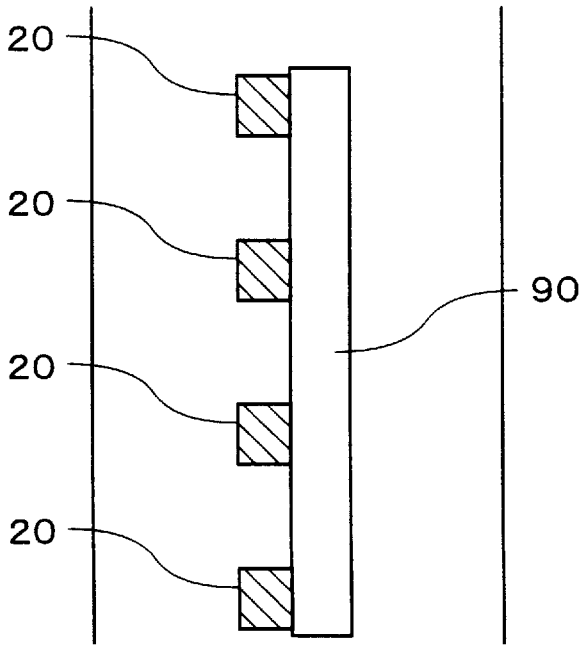
FIG. 6 is a view corresponding to FIG. 3, showing a second modified example of outlet ports provided corresponding to the negative electrodes.
Figure 7:
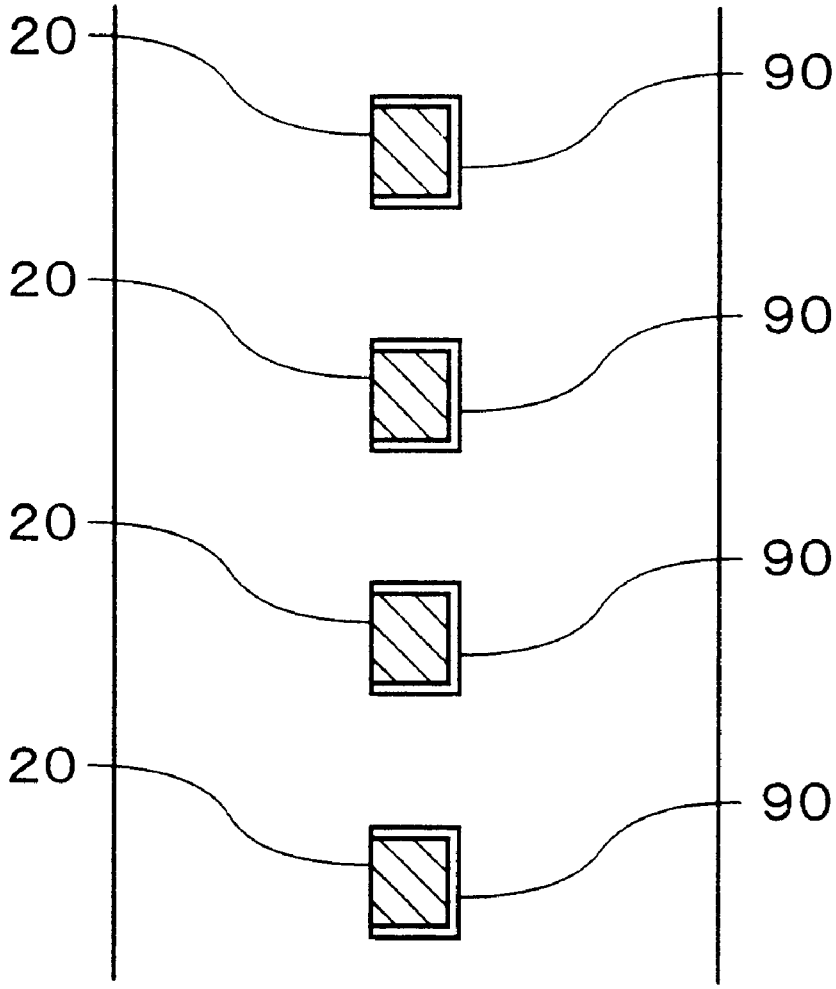
FIG. 7 is a view corresponding to FIG. 3, showing a third modified example of outlet ports provided corresponding to the negative electrodes.

Moreover, in the abovementioned embodiment, as shown in FIG. 3, the discharge ports 90 are formed in a circular shape and are provided separated by a predetermined distance L from the negative electrodes 20 on the upstream side. However the shape of the discharge ports and the arrangement positions may be appropriately set. For example as shown in FIG. 5, this may be effected by forming the discharge ports 90 in a square shape and providing these respectively adjacent to the respective negative electrodes 20. Furthermore, as shown in FIG. 6, this may be effected by forming the discharge ports 90 in a strip form and providing this adjacent to the respective negative electrodes 20. Moreover, as shown in FIG. 7, this may be effected by forming the discharge ports 90 in a U-shape and providing these surrounding the respective negative electrodes 20 from the upstream side.

Furthermore, in the abovementioned embodiments, the electrolyte C is circulated in the fluid supply device 100 and naturally cooled. However the invention may also be effected by providing a separate forced cooling device and forcefully cooling the electrolyte C by means of this forced cooling device. The invention may also be effected by adopting a fluid supply device which does not incorporate a cooling function, for the fluid supply device for supplying fluid to the discharge port.

What is claimed is:

1. A printing apparatus, comprising:

a rotation drum having a surface acting as a positive electrode and rotating in a rotation direction;

a plurality of negative electrodes arranged in an axial direction of said rotation drum and spaced from said surface of said rotation drum to form an ink coagulation space there between;

an injector for injection liquid ink into said ink coagulation space from a position upstream of said ink coagulation space;

an energizer for energizing selected ones of said negative electrodes as said rotation drum is rotating for coagulating and accreting part of said ink in said ink coagulation space onto said surface of said rotation drum;

a removal device arranged downstream of said ink coagulation space for removing residual non-coagulated ink from said surface of said rotation drum;

a transfer device arranged downstream of said removal device for transferring ink which has been coagulated and accreted to said surface of said rotation drum onto an object to be printed; and a discharge port arranged upstream of said coagulation space and downstream of a point at which said liquid ink is injected by said injector for discharging a fluid towards at least said ink coagulation space.

2. A printing apparatus according to claim 1, wherein said fluid is an electrolyte.

3. A printing apparatus according to claim 1, wherein said fluid is a washing fluid.

4. A printing apparatus according to claim 3, further comprising a fluid supply which momentarily supplies said washing fluid at a high pressure.

5. A printing apparatus according to claim 4, wherein said fluid supply device cools said fluid supplied to said discharge port.

6. A printing apparatus according to claim 1, further comprising a coating unit arranged upstream of said injector for coating an olefinic substance containing a metallic oxide onto said surface of said rotation drum.

7. A printing apparatus according to claim 1, further comprising a washing device arranged downstream of said transfer device, for washing said surface of said rotation drum.

8. A printing apparatus according to claim 1, further comprising a fluid supply device for supplying said fluid to said discharge port.

9. A printing apparatus according to claim 8, said fluid supply device continually supplies said fluid.

10. A printing apparatus according to claim 9, wherein said fluid supply device cools said fluid supplied to said discharge port.

11. A printing apparatus according to claim 8, wherein said fluid supply device cools said fluid supplied to said discharge port.

12. A printing apparatus according to claim 1, wherein said injector places said liquid ink on said surface of said rotation drum and a said discharge port places an electrolyte liquid on said liquid ink so as to form an electrolyte layer between said liquid ink and said negative electrodes in said ink coagulation space.

13. A printing apparatus according to claim 12, wherein said electrolyte liquid does not coagulate in the presence of an electric field formed between said positive and negative electrodes when said negative electrodes are energized.

14. A printing apparatus according to claim 1, wherein the negative electrodes are located above said surface of said rotation drum.

15. An electro coagulation printing apparatus comprising:

a positive electrode;

a plurality of negative electrodes arranged above said positive electrode;

a liquid ink injector having an injection port of which faces toward a space located between said positive electrode and said negative electrodes;

an energizer which is connected to said negative electrodes;

a non-coagulated ink removal device in operative engagement with said positive electrode;

a coagulated ink transferring device in operative engagement with said positive electrode; and an electrolyte discharging device arranged between said negative electrodes and said injecting port of said liquid ink injector, wherein said positive electrode rotates in a direction from said negative electrodes toward said non-coagulated ink removal device and said coagulated ink transferring device in this order.

16. A printing apparatus according to claim 15, wherein said liquid ink injector places said liquid ink on a surface of said positive electrode and a said electrolyte discharging device places a liquid electrolyte on said liquid ink so as to form an electrolyte layer between said liquid ink and said negative electrodes in said space.

17. A printing method using a positive electrode and a negative array consisting a plurality of negative electrodes, wherein said positive electrode and said negative electrode array are spaced apart from each other, said method comprising the steps of:

(a) injecting liquid ink, which is coagulatable by electrical energizing, into a space between said positive electrode and said negative electrode array;

(b) discharging a fluid onto said negative electrode array;

(c) forming a laminate consisting of a liquid ink layer comprising said liquid ink and a fluid layer comprising said fluid between said positive electrode and said negative electrode array;

(d) energizing selected negative electrodes to coagulate part of said liquid ink and to form coagulated ink on said positive electrode according to an image to be printed;

(e) removing liquid ink which is not coagulated; and (f) transferring said coagulated ink onto an object to be printed.

18. A printing method according to claim 17, wherein said fluid is an electrolyte.

19. A printing apparatus according to claim 18, wherein said electrolyte does not coagulate in the presence of electric field formed between sad positive electrode and said negative electrode array.

* * * * *